US008044287B2

(12) United States Patent
Jackson

(10) Patent No.: US 8,044,287 B2
(45) Date of Patent: Oct. 25, 2011

(54) PITCH ADJUSTMENT DEVICE FOR STRING INSTRUMENTS

(76) Inventor: David H. Jackson, Dahlonega, GA (US)

( * ) Notice: Subject to any disclaimer, the term of this patent is extended or adjusted under 35 U.S.C. 154(b) by 59 days.

(21) Appl. No.: 12/686,821

(22) Filed: Jan. 13, 2010

(65) Prior Publication Data

US 2011/0167980 A1 Jul. 14, 2011

(51) Int. Cl.
*G10D 3/14* (2006.01)

(52) U.S. Cl. ..... 84/312 R

(58) Field of Classification Search ..... 84/312 R, 84/312 P, 313
See application file for complete search history.

(56) References Cited

U.S. PATENT DOCUMENTS

| | | | | | |
|---|---|---|---|---|---|
| 2,973,682 | A | * | 3/1961 | Fender | 84/312 P |
| 3,014,395 | A | * | 12/1961 | Blair | 84/312 P |
| 3,390,600 | A | | 7/1968 | Kelley, Jr. | |
| 3,422,716 | A | * | 1/1969 | Alifano | 84/312 P |
| 3,592,096 | A | * | 7/1971 | Ritter | 84/312 P |
| 3,688,631 | A | * | 9/1972 | Jackson | 84/312 P |
| 4,080,864 | A | * | 3/1978 | Jackson | 84/312 P |
| 4,157,050 | A | * | 6/1979 | Lashley | 84/312 P |
| 4,175,467 | A | * | 11/1979 | Lashley | 84/312 P |
| 4,342,249 | A | * | 8/1982 | McCormick et al. | 84/312 P |
| 5,044,247 | A | * | 9/1991 | Stepp | 84/312 P |
| 5,092,214 | A | * | 3/1992 | Flynn | 84/312 P |
| 5,883,320 | A | | 3/1999 | Lashley | |
| 6,002,075 | A | * | 12/1999 | Carter | 84/312 P |
| 7,247,779 | B2 | | 7/2007 | Zumsteg | |
| 7,465,860 | B2 | | 12/2008 | Jackson | |
| 7,645,927 | B1 | * | 1/2010 | Jackson | 84/312 R |
| 2008/0017011 | A1 | | 1/2008 | Jackson | |

OTHER PUBLICATIONS

Restriction Requirement dated Jun. 5, 2009 in U.S. Appl. No. 12/199,802, filed Aug. 28, 2008, inventor: David H. Jackson, (6 pages).

Notice of Allowance dated Sep. 14, 2009 in U.S. Appl. No. 12/199,802, filed Aug. 28, 2008, inventor: David H. Jackson, (14 pages).

* cited by examiner

*Primary Examiner* — Jianchun Qin
(74) *Attorney, Agent, or Firm* — Vista IP Law Group LLP

(57) ABSTRACT

A pitch adjustment device for selectively adjusting the pitch of the string(s) of a stringed musical instrument. Each string of the instrument is attached to a respective pitch adjustment device. Each pitch adjustment device includes a pivotable string puller wherein pivoting of the string puller adjusts the pitch on the string. A pulley is rotatably mounted to the string puller such that movement of the pulley causes the string puller to pivot. A cable is wrapped around the pulley and has a first side extending from one side of the pulley and a second side extending form the other side of the pulley. A plurality of actuators are operably coupled to the first and second sides of the cable. The actuators move the cable, which moves the pulley, which in turn pivots the string puller, thereby adjusting the pitch of the string.

8 Claims, 3 Drawing Sheets

PITCH ADJUSTMENT DEVICE FOR STRING INSTRUMENTS

FIELD OF THE INVENTION

The field of the invention generally relates to stringed musical instruments, and more particularly to a device for selectively adjusting the tension (and therefore pitch) of the strings of such musical instruments while the instrument is being played.

BACKGROUND OF THE INVENTION

In the past, various pitch adjusting mechanisms for stringed musical instruments have been provided. These pitch adjusting mechanisms generally operate by selectively increasing or decreasing the tension or pitch of a string by moving one of the secured ends of the string to either increase the tension (to raise the pitch) or decrease the tension (to lower the pitch).

These types of pitch adjusting mechanisms have found widespread application on steel guitars. In general, a steel guitar is a generally horizontally mounted guitar having a head end and a tail end and a plurality of strings extending therebetween. The head end is provided with a plurality of tuning keys (one for each string) to which one end of a string is secured. The tuning keys allow adjustment of the pitch of each string to tune the guitar. The other end of the string is secured to a bridge at the tail end of the guitar.

Typical examples of pitch adjusting mechanisms for string instruments, such as a steel guitar, are found in U.S. Pat. No. 3,688,631 and U.S. Pat. No. 3,390,600. These patents are expressly incorporated by reference herein in their entireties. Each of these patents discloses a pitch adjusting mechanism for adjusting the pitch of an individual string both upwardly or downwardly. The mechanisms in both of these two patents also have in common that the pitch adjusting mechanism is provided at the bridge end of the strings and the mechanisms comprise relatively complicated systems of levers, springs and linkages. In order to provide for both raising and lowering the pitch of the string with a single lever attached to the string, these mechanisms provide for a system which allows the single lever to be selectively actuated in both directions, i.e. clockwise and counter-clockwise, and also provide a means for returning the string to the open tune position (this means the normal pitch of the string without actuation of the pitch adjusting mechanism) upon de-actuation. Accordingly, the springs and lever arms of each of the parts of these mechanisms must be delicately balanced to provide proper operation and to minimize or avoid mis-tuning.

Therefore, there is need for a pitch adjustment device for stringed instruments which overcomes the problems associated with prior devices.

SUMMARY OF THE INVENTION

The present invention comprises an innovative pitch adjustment device for selectively adjusting the pitch of the string(s) of a stringed musical instrument. The device provides for very stable and consistent pitch in the raised, lowered and open pitch of each string, while also providing relatively simple tuning adjustment for each pitch position. In other words, it is a straightforward and simple task to tune each string to provide the desired open pitch, and the pitch in the raised position and the lowered position.

In one embodiment, the pitch adjustment device comprises a pivotable string puller having a first end, a second end and a middle section between the first and second ends. The string puller is pivotably mounted on a pivot coupled to the first end of the string puller, such that the string puller rotates about a first axis defined by the pivot. The first end of the string puller has a string support surface which supports the string of the musical instrument, such as a steel guitar. The string support and string puller are arranged such that pivoting of the string puller adjusts the tension of the string, thereby changing the pitch of the string. The string support surface may comprise a smooth, curved surface upon which the string bears. The string support surface may also comprise a knife edge surface upon which the string rides and defines one end of the scale of the string.

A pulley is rotatably mounted to the middle section of the string puller. The pulley rotates about a second axis which is substantially parallel to the first axis. A pitch adjustment cable is wrapped around the pulley, such that a first side of the cable extends from a first side of the pulley, and a second side of the cable extends from a second side of the pulley. The first side of the pulley is closer to the pivot than the second side of the pulley. The first side of the cable is coupled to a first actuator and the second side of the cable is coupled to a second actuator.

The first actuator is configured to actuate between a first state and a second state thereby causing the first side of the cable to move between a "normal position" and an "adjusted position." As used herein, the term "normal position" means the state of a particular element in which the string is tuned to the "open" tone, or normal pitch of the string; the term "adjusted position" means the state of a particular element in which the string has been adjusted from the open tone to a higher pitch or a lower pitch; the term "raised position" means the state of a particular element in which the string has been adjusted from the open tone to a higher pitch, e.g. a half note or full note higher; and the term "lower position" means the state of a particular element in which the string has been adjusted from the open tone to a lower pitch. With the first actuator in the first state, the first side of the cable is in the normal position. Actuation of the first actuator from the first state to second state causes the first side of the cable to move from the normal position to the adjusted position. Movement of the first side of the cable from the normal position to the adjusted position causes the pulley to move, thereby pivoting the string puller in a first direction. Pivoting of the string puller changes the tension on the string thereby adjusting the pitch of the string. Actuating the first actuator back to the first state moves the first side of the cable back to the normal position, thereby pivoting the string puller back to its original position, and returning the string to its "open" pitch.

Similarly, the second actuator is configured to actuate between a first state and a second state thereby causing the second side of the cable to move between a normal position and an adjusted position. With the second actuator in the first state, the second side of the cable is in the normal position. Actuation of the second actuator from the first state to second state causes the second side of the cable to move from the normal position to the adjusted position. Movement of the second side of the cable from the normal position to the adjusted position causes the pulley to move, thereby pivoting the string puller in a second direction. Pivoting of the string puller changes the tension on the string thereby adjusting the pitch of the string. Actuating the second actuator back to the first state moves the second side of the cable back to the normal position, thereby pivoting the string puller back to its original position, and returning the string to its "open" pitch.

The second direction of pivoting of the string puller is typically opposite of the first direction. For example, if the first direction is clockwise, then the second direction would be counterclockwise, or vice versa. For instance, the first actuator could be configured to raise the pitch and the second actuator could be configured to lower the pitch. However, in some embodiments, the second actuator (or a third actuator or more, if provided) may be configured such that the second direction is the same as the first direction, but the adjusted position may move the cable a different distance than the first actuator (or a second actuator). For example, the first actuator may raise the pitch of the string one full note (the term "note" is used interchangeably herein with the term "tone"), whereas the second actuator might raise the pitch a half note or two full notes.

The actuators may be mechanical levers coupled to the cable, or they may be electromechanical devices such as solenoids or other suitable electromechanical devices which could be used to move the cable. For example, stepper motors, pneumatic actuators, or the like could be utilized. In the case of mechanical levers, the levers may be coupled to a system of rocking assemblies and/or pedals (e.g. foot and/or knee pedals) such as those described in U.S. Pat. No. 3,688,631. For electromechanical devices, the device may be coupled to actuators such as pedals having switches operatively coupled to the electromechanical actuator.

In another embodiment, the pitch adjustment device may comprise a string puller having a first end, a second end and a middle section between the first and second ends. The string puller is pivotably mounted on a pivot coupled to the first end of the string puller, such that the string puller rotates about a first axis defined by the pivot. The first end of the string puller has a string support surface which supports the string of the musical instrument, such as a steel guitar. The string puller is arranged such that pivoting of the lever adjusts the tension of the string, thereby changing the pitch of the string. The string support surface may be the same or similar to that described above.

A pivoting link having a first end and a second end is pivotably coupled to the second end of the string puller using a pivot, such as a pin. The second end of the pivoting link also bears against a second pivot, about which the pivoting link may pivot. In addition, a third pivot is provided at the first end of the pivoting link, about which the pivoting link may also pivot. A first pull rod is coupled to the first end of the pivoting link, and a second pull rod is coupled to the second end of the pivoting link. A first actuator is coupled to the first pull rod and a second actuator is coupled to the second pull rod.

The first actuator is configured to actuate between a first state and a second state thereby causing the first pull rod to move between a normal position and an adjusted position. Movement of the first pull rod from the normal position to the adjusted position causes the pivoting link to pivot about the second pivot, thereby pivoting the string puller in a first direction. Pivoting of the string puller changes the tension on the string thereby adjusting the pitch of the string. With the first actuator in the first state, the first pull rod is in the normal position. Actuating the first actuator from the first state to the second state moves the first pull rod to the adjusted position which adjusts the pitch of the string. Actuating the first actuator back to the first state moves the first pull rod back to the normal position, thereby pivoting the string puller back to its original position, and returning the string to its "open" pitch.

Likewise, the second actuator is configured to actuate between a first state and a second state thereby causing the second pull rod to move between a normal position and an adjusted position. Movement of the second pull rod from the normal position to the adjusted position causes the pivoting link to pivot about the third pivot, thereby pivoting the string puller in a second direction. Pivoting of the string puller changes the tension on the string thereby adjusting the pitch of the string. With the second actuator in the first state, the second pull rod is in the normal position. Actuating the second actuator from the first state to the second state moves the second pull rod to the adjusted position which adjusts the pitch of the string. Actuating the second actuator back to the first state moves the second pull rod back to the normal position, thereby pivoting the string puller back to its original position, and returning the string to its "open" pitch.

As in the embodiment described above, the second direction of pivoting of the string puller is typically opposite of the first direction. However, in some embodiments, the second actuator (or a third actuator) may be configured such that the second direction is the same as the first direction, but the actuated position moves the cable a different distance than the first actuator (or a second actuator), such as to adjust the pitch a half tone, or two tones.

The same types of actuators as described above may be utilized with this pull rod embodiment.

Additional aspects and features of the pitch adjustment device and related mechanisms of the present invention will become apparent from the drawings and detailed description provided below.

BRIEF DESCRIPTION OF THE DRAWINGS

The invention is illustrated by way of example and not limitation in the figures of the accompanying drawings, in which like reference numbers refer to similar elements, and in which.

DETAILED DESCRIPTION OF THE INVENTION

Figure 1:
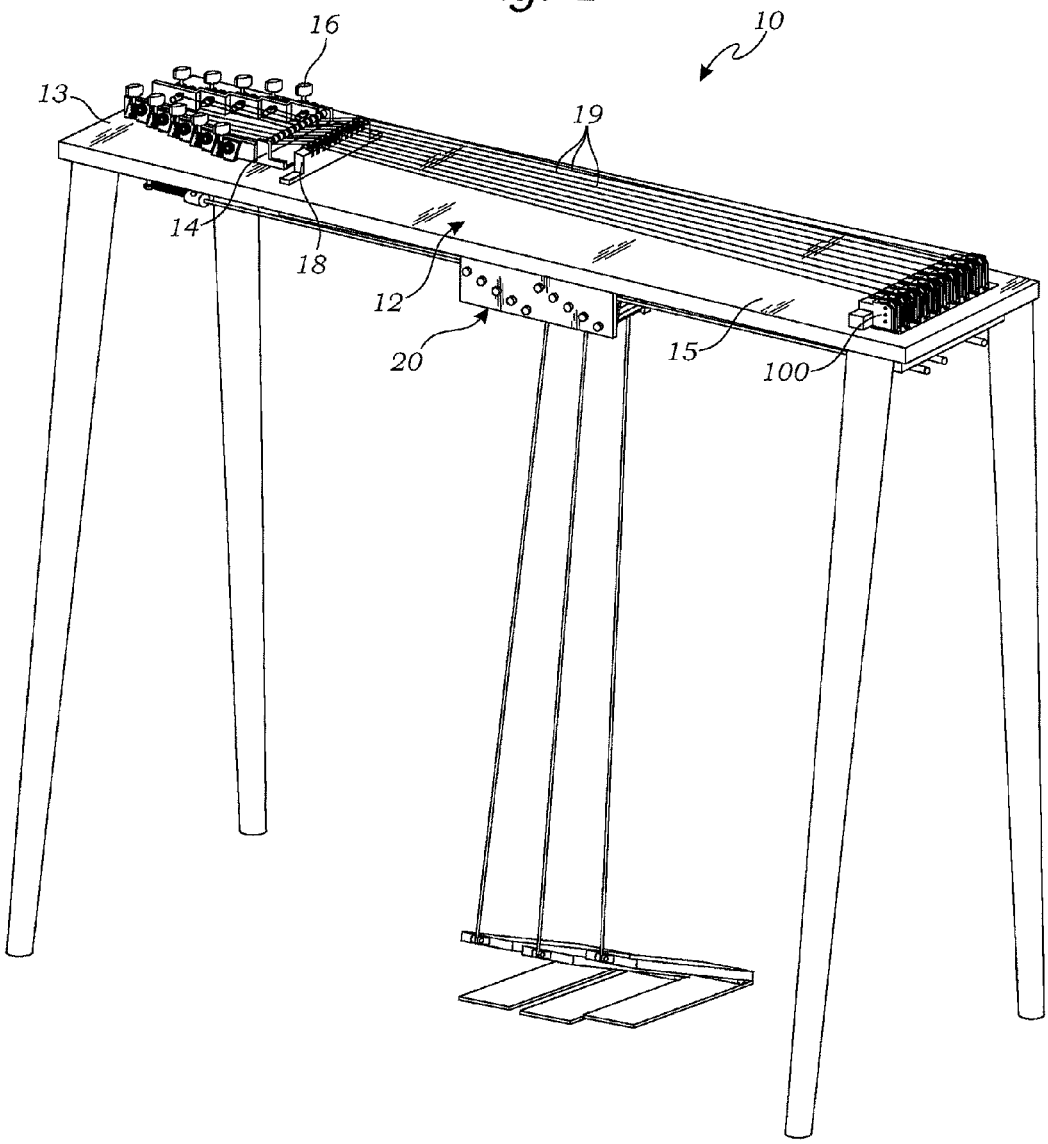
FIG. 1 is a side perspective view of an exemplary steel guitar having the pitch adjustment device of the present invention.

Referring to FIG. 1, the pitch adjustment device of the present invention will be described in connection with an exemplary instrument, in this case a steel guitar 10. It should be understood that the pitch adjustment device and other related features are not limited to a steel guitar 10 as shown and described, but can be applied to any stringed instrument. Therefore, the present invention is not limited to the embodiment on a steel guitar. Moreover, although the steel guitar 10 is shown with a single neck, it is common for steel guitars to have two necks, a front neck and a rear neck, as shown in U.S. Pat. No. 3,688,631. It should be understood that the present invention can easily be applied to both necks of a dual neck steel guitar.

The steel guitar 10 comprises a frame 12 having a head end 13 and a tail end 15. A plurality of strings (in this example, the guitar 10 has 10 strings) generally indicated at 19. The head end of each string 19 passes over a bridge nut 20 and then is operatively coupled to a tuning key 16. The tuning keys 16 are operably connected to a key frame 14. The tail end of each string 19 is operatively coupled to a pitch adjustment device 100 which is attached to the tail end 15 of the frame 12. There is a tuning key 16 and first pitch adjustment device 100 for each of the strings 19. All of the pitch adjustment devices 100 are substantially identical for each string 19, and therefore it is sufficient to describe these assemblies for just one of the strings 19, as shown in FIGS. 2-5. The assemblies for the other strings 19 are substantially identical, except that the location of some components will vary in order to accommodate each of the assemblies for each of the strings. For example, as can be seen in FIG. 1, the location of each of the pitch adjustment devices 100 varies so that all 10 devices 100 can fit on the head end 13 of the guitar 10.

Figure 2:
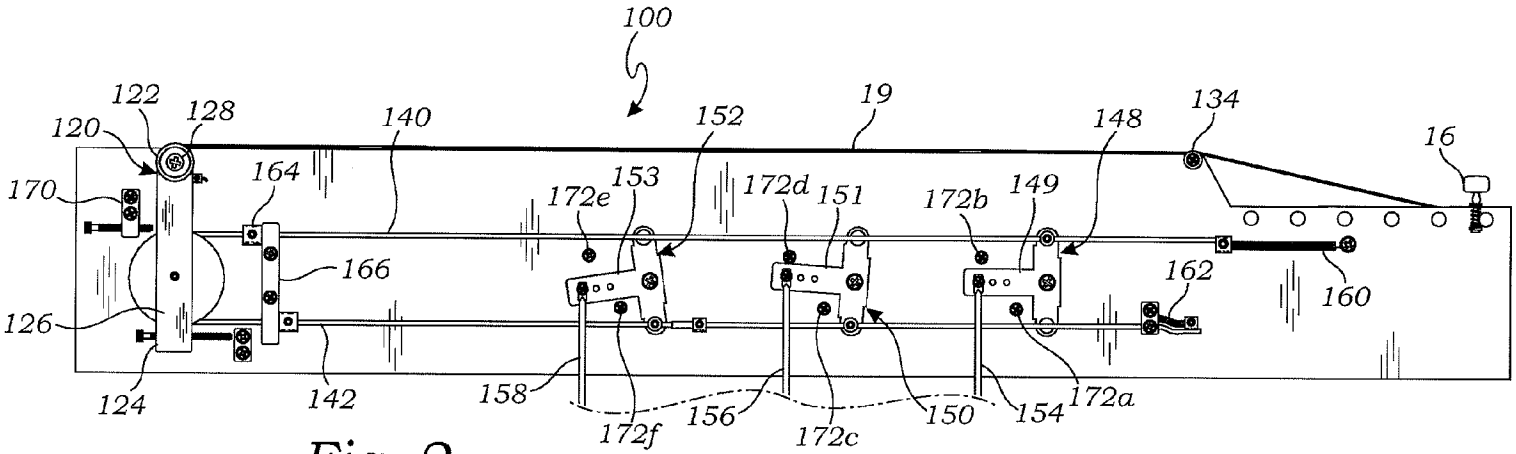
FIG. 2 is side view of a pitch adjustment device according to one embodiment of the present invention, shown for a single string of the steel guitar of FIG. 1.
Figure 3:
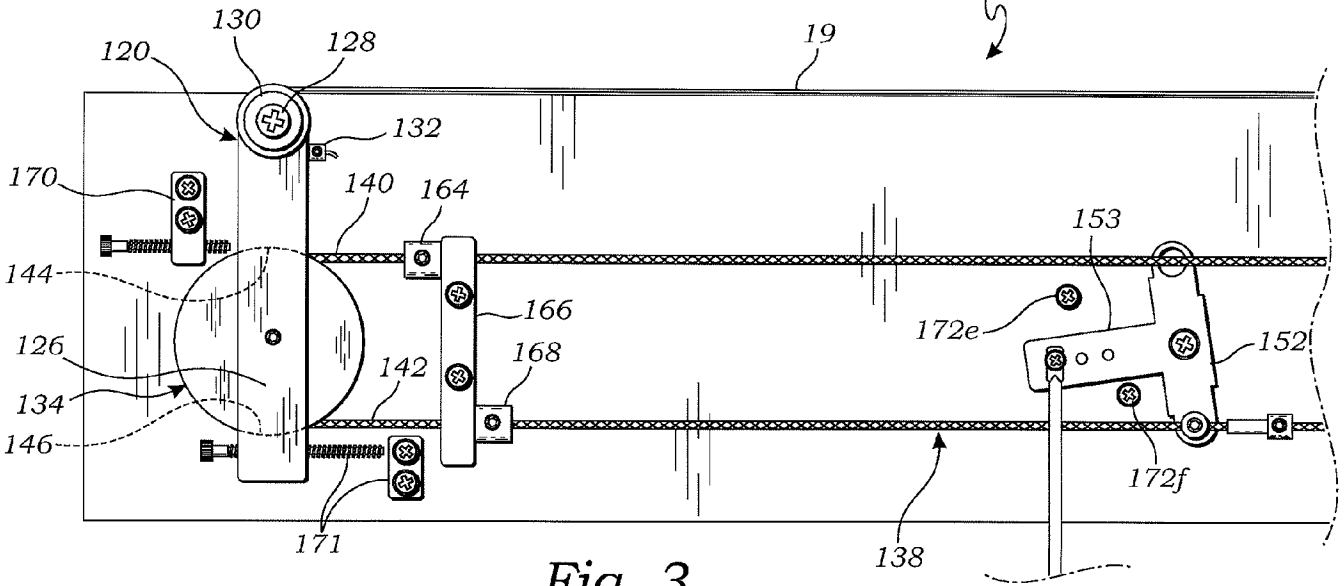
FIG. 3 is an enlarged, partial side view of the pitch adjustment device of FIG. 2.

Referring now to FIGS. 2-3, one embodiment of the pitch adjustment device 100 according to the present invention is illustrated. The pitch adjustment device 100 comprises a pivotable string puller 120. The string puller 120 has a first end 122, a second end 124 and a middle section 126. The string puller 120 is pivotably mounted on a first pivot 128 coupled to the first end 122 of the string puller 120, such that the string puller 120 rotates about a first axis defined by the pivot 122. The pivot 120 may be a screw, bolt, rod, or other suitable device which can pivotably support the string puller 120. The first end 122 of the string puller 120 has a string support surface 130 which supports the string 19 of the steel guitar. A string attachment 132 secures the tail end of the string 19 to the string puller 120. Thus, as the string puller 120 is pivoted about the first pivot 128, the tension on the string 19 is adjusted, thereby changing the pitch of the string.

The string support surface 130 typically comprises a smooth, circumferential surface upon which the string 19 bears. The string support surface 130 may also comprise a knife edge surface (not shown) upon which the string 19 rides and which defines one end of the scale of the string 19. Such knife edge surfaces are described in detail in U.S. patent application Ser. No. 11/489,318, the disclosure of which is incorporated by reference herein in its entirety. In this exemplary embodiment, the tail end of the string 19 rests on the string support surface 130, but it is to be understood that the pitch adjustment device 100 could alternatively be positioned at the tail end of the instrument such that the tail end of the string 19 rests on the string support surface 130.

In FIG. 2, the head end of the string 19 is shown supported on the bridge nut 134 and then operatively coupled to the tuning key 16. The tuning key 16 may be any suitable tuning adjustment device, as is well known in the art, which may include machine heads, worm gears, tuning knobs, tuning shafts, etc.

A pulley 134 is rotatably mounted on a second pivot 136 to the middle section 126 of the string puller 120. The pulley 134 rotates about a second axis which is substantially parallel to the first axis. A pitch adjustment cable 138 wraps around the pulley 134. The pulley 134 may have a groove which receives the cable 138 and keeps the cable 138 from slipping off the pulley 134. A first side 140 of the cable 138 extends from a first side 144 of the pulley 134, and a second side 142 of the cable 138 extends from a second side 146 of the pulley 134. The first side 144 of the pulley 134 is positioned closer to the first pivot 128 than the second side 146 of the pulley 134.

The end of the first side 140 of the cable 138 is coupled to a first biasing spring 160, which applies a force pulling the cable 138 away from the pulley 134. A first stop 164 is attached to the first side 140 of the cable 138 in a position in which the spring puller 120 is substantially perpendicular (i.e. a vertical position as shown in FIGS. 2-3) to the string 19 when the first stop 164 is firmly against the stop plate 166. When the first actuator 148 is in the normal position, the first biasing spring 160 pulls the first side 140 of the cable 138 to the right until the first stop is firmly against the stop plate 166.

The end of the second side 142 of the cable 138 is coupled to a second biasing spring 162 which applies a force pulling the second side 142 away from the pulley 134. A second stop 168 is attached to the second side 142 of the cable 138 in a position in which the spring puller 120 is substantially perpendicular (i.e. a vertical position as shown in FIGS. 2-3) to the string 19 when the first stop 164 is firmly against the stop plate 166. When the first actuator 148 (described below) is in the normal position, the first biasing spring 160 pulls the first side 140 of the cable 138 to the right until the first stop 164 is firmly against the stop plate 166.

As shown in FIGS. 2-3, when the spring puller 120 is substantially perpendicular to the string 19, the spring puller 120 is in the normal position, such that the string 19 is in the open tuning position (open pitch). It should be understood that the present invention is not limited to the configuration in which the spring puller 120 is substantially perpendicular to the string 19 in the open tuning position, and that other configurations are possible within the scope of the present invention. In the absence of a raise or lower actuation as described below, this open tuning position is securely and consistently maintained by the first biasing spring 160 and the first and second stops 164 and 168. So long as the first biasing spring 160 provides sufficient force to provide a moment on the spring puller 120 to overcome the moment provided by the tension on the string 19, then the spring puller 120 will stay firmly positioned in the normal position. There is no delicate balancing of spring forces and moment arms required as in many of the prior art devices described above.

The first side 140 of the cable 138 is coupled to a first actuator 148. The second side 142 of the cable 138 is coupled to a second actuator 150 and a third actuator 152. In this exemplary embodiment of the pitch adjustment device 100, the actuators 148, 150 and 152 respectively comprise mechanical levers 149, 151 and 153 each secured to their respective portion of the cable 138. The actuators 148, 150 and 152 further comprise a first pull rod 154, second pull rod 156, and third pull rod 158 which are respectively coupled to the levers 149, 151, and 153. Pulling or pushing each of the pull rods 154, 156 or 158 causes the respective lever 148, 150 or 156 to rotate, thereby moving the cable 138.

More specifically, the first actuator 148 is arranged such that the normal position of the lever 149 occurs with the first pull rod 154 in the up position. To actuate the first actuator 148, the first pull rod 154 is pulled downward rotating the lever 149 in a counter-clockwise direction to the lowered position, thereby moving the first side 140 of the cable 138 to the left (as shown in FIGS. 2-3). This in turn causes the pulley 134 to move to the left which allows the string puller 120 to rotate in a clockwise direction. Rotation of the string puller 120 in a clockwise direction lowers the tension of the string 19, thereby lowering the pitch of the string 19. Actuating the first actuator in the opposite direction, i.e. moving the pull rod 154 upward, returns the string 19 to its open pitch. Thus, in the configuration of FIGS. 2-3, the first actuator 148 is arranged for lowers (i.e. lowering the pitch of the string 19 from the open tuning). Thus, the first actuator 148 may also be called a lower actuator 148.

In order to control the amount of pitch adjustment provided by first actuator 148 when actuated to the lowered position, an adjustable first pitch stop 170 is configured to limit the amount of rotation of the spring puller 170 in the clockwise direction. In this example, the first pitch stop 170 comprises a screw threaded through a stationary support.

Similar to the first actuator 148, the second actuator 150 is configured such that the normal position of the lever 151 occurs with the second pull rod 156 in the up position. Likewise, the second actuator 150 is actuated by pulling the first pull rod 156 downward rotating the lever 151 in a clockwise direction to the raised position, which moves the second side 142 of the cable 138 to the right. This in turn causes the pulley 134 to move to the right which causes the string puller 120 to rotate in a counter-clockwise direction. Rotation of the string puller 120 in a counter-clockwise direction raises the tension of the string 19, thereby raising the pitch of the string 19. Then, actuating the second actuator 150 from the raised position in the opposite direction, i.e. moving the pull rod 156 upward, returns the string 19 to its open pitch. Thus, in the configuration of FIGS. 2-3, the second actuator 150 is arranged for raises (i.e. raising the pitch of the string 19 from the open tuning). Thus, the second actuator 150 may also be called a raise actuator 150.

In order to control the amount of pitch adjustment provided by second actuator 150 when actuated to the raised position, an adjustable second pitch stop 171 is configured to limit the amount of rotation of the spring puller 170 in the counter-clockwise direction. The second pitch stop 171 may also comprise a screw threaded through a stationary support.

The third actuator 152 is also a raise actuator, and it is arranged and operates the same as the second actuator 150, except that the third actuator has a stop **172*f* which limits the amount of pitch adjustment provided by the third actuator 152 a different amount than the second actuator 150. For example, if the second actuator 150 provides a raise of one full note, the stop 172*f* may be set such that the third actuator 152** provides a raise of a half note.

A pair of pedal stops 172 may be provided on each of the actuators 148, 150 and 152 which limit the travel of the pull rods 154, 156 and 158 and the levers 149, 151 and 153. One or more of the pedal stops 172 may be adjustable like the adjustable pedal stops 272 described below.

The tuning and operation of the pitch adjustment device 100 is fairly straightforward. There are three steps to tuning each string 19, namely (1) open tuning to tune the open pitch; (2) raised tuning to tune the raised pitch; and (3) lowered tuning to tune the lowered pitch. To open tune the string 19, the actuators 148, 150 and 152 are set to their normal position, such that the stop 164 is firmly against the stop plate 166. Then, the string 19 is tuned to its open pitch using the using the tuning key 16, just like any standard guitar. For lowered tuning, the lower actuator 148 is actuated to its lowered position such that the string puller 120 contacts the first pitch stop 170. Any other actuators are left in their normal position. The first pitch stop 170 is then adjusted to tune the string 19 to the desired lowered pitch. For raised tuning, the raise actuator 150 or 152 is actuated to its raised position such that the string puller 120 rotates to the limit of the second pitch stop 171, with any other actuators left in their normal position. The second pitch stop 171 is then adjusted to tune the string 19 to the desired raised pitch.

Figure 4:
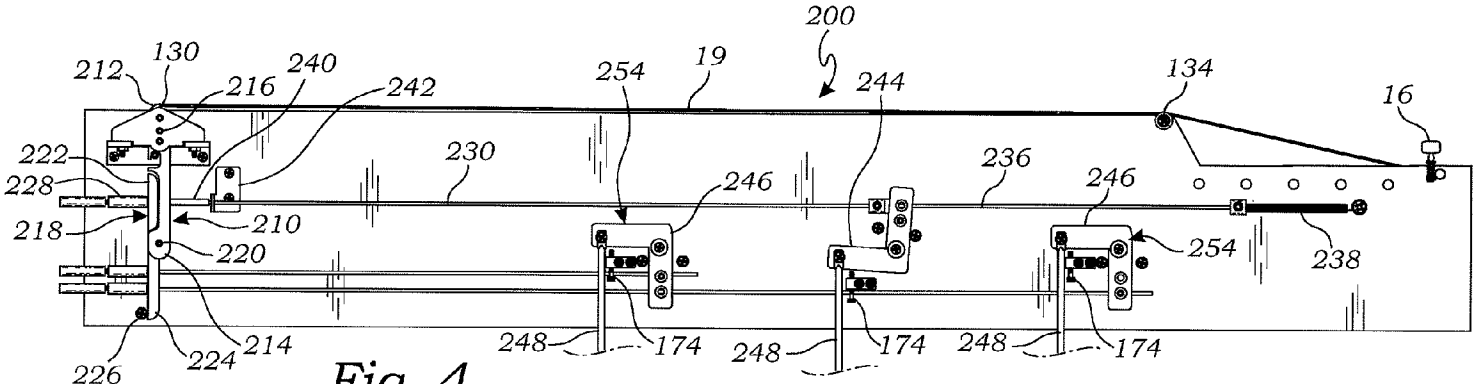
FIG. 4 is side view of a pitch adjustment device according to another embodiment of the present invention, shown for a single string of the steel guitar of FIG. 1.
Figure 5:
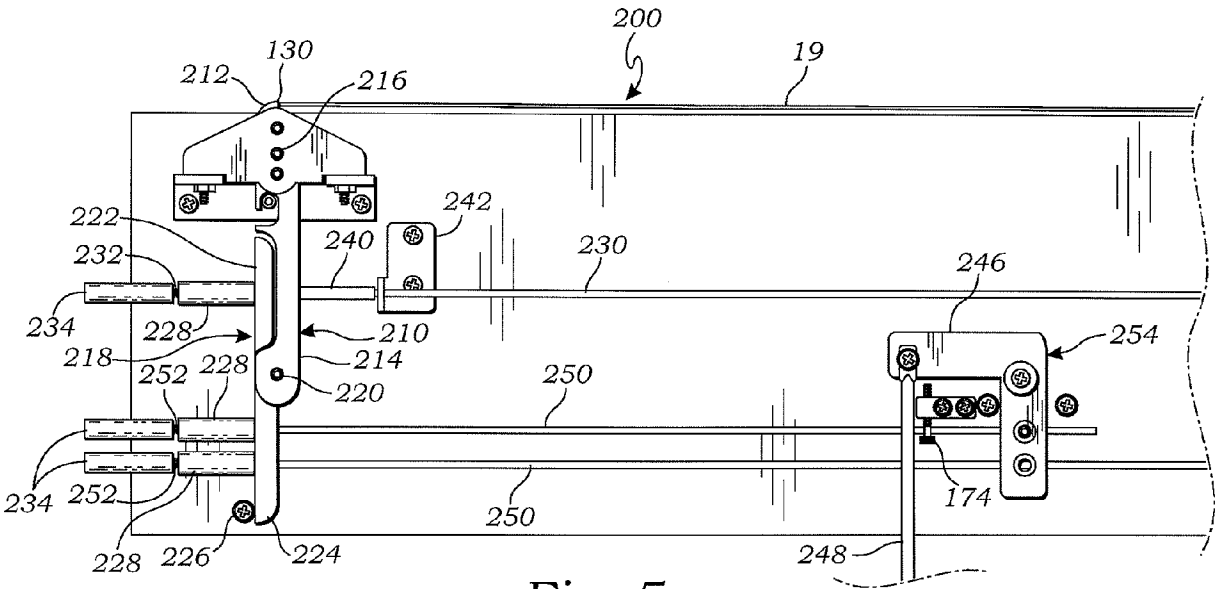
FIG. 5 is an enlarged, partial side view of the pitch adjustment device of FIG. 4.

Turning to FIGS. 4-5, another embodiment of a pitch adjustment device 200 is illustrated, and will now be described in detail. The pitch adjustment device 200 may be utilized on a stringed instrument in the same way as the pitch adjustment device 100 described above, including with respect to the steel guitar 10.

The pitch adjustment device 200 comprises a string puller 210 having a first end 212 and a second end 214. The string puller 210 is pivotably mounted on a puller pivot 216 coupled to the first end 212 of the string puller 210, such that the string puller 210 may rotate about a first axis defined by the puller pivot 216. A string support surface 130 is provided on the first end 212 of the string puller 212 which supports the string 19. The tail end of the string 19 is secured to the first end 212 of the string puller 212. As can be seen in FIGS. 4 and 5, pivoting of the string puller 210 will adjust the tension on the string 19, thereby changing the pitch of the string 19.

A pivoting link 218 having a first end 222 and a second end 224 is pivotably coupled to the second end 214 of the string puller 210 using a first link pivot 220. The link pivot 220 may be a pin or other suitable device such as a shaft, screw, etc. A second link pivot 226 is provided at the second end 224 of the pivoting link 218. Under certain conditions described below, the second end 224 may bear against the second link pivot 226, and the pivoting link 218 may pivot about the second link pivot 226. A first sleeve 228 is positioned at the first end 222 of the pivoting link 218. The first sleeve 228 is slidably disposed on a lower pull rod 230. One side of the first sleeve 228 bears against the first end 222 of the pivoting link 218 such that the first sleeve 228 provides a third link pivot about which the pivoting link 218 may pivot, under certain conditions as described below.

The head end of the string 19 is supported on the bridge nut 134 and then is operatively coupled to the tuning key 16, which is described in detail above.

A first end 232 of the lower pull rod 230 is operatively coupled to the first end 222 of the pivoting link 218 via the first sleeve 228 and a tuning fastener 234. The tuning fasteners 234 are adjustable such that they can be moved longitudinally and secured at various positions along the pull rods. The tuning fasteners 234 are used to tune the raised and lowered pitch of the string 19, as described below. The second end 236 of the lower pull rod 230 is coupled to a first biasing spring 238 which applies a force pulling the second end 236 of the pull rod 230 away from the string puller 210. A stop sleeve 240 is slidably disposed on the lower pull rod 230 between the pivoting link 218 and a lower stop 242. When the lower pull rod 230 is in the normal position, one side of the stop sleeve 240 bears against the first end 222 of the pivoting link 218 and the other side of the stop sleeve 240 bears against the lower stop 242, thereby preventing the first end 222 of the pivoting link 218 from pivoting in a clockwise direction.

As shown in FIGS. 2-3, when the spring puller 210 is substantially perpendicular to the string 19, the spring puller 210 is in the normal position, with the string 19 in the open tuning position. This position is repeatably and securely attained in the absence of a raise or lower actuation because the pivoting link is held in the perpendicular position by biasing spring 238 and stop sleeve 240 at the first end 222 of the pivoting link 218 and by the second link pivot 226 at the second end 224 of the pivoting link 218. The perpendicular position of the pivoting link 218 in turn positions the string puller 210 in the perpendicular position.

A lower actuator 244 is coupled to the lower pull rod 230. The lower actuator 230 is the same or similar to the actuators described above, and includes a lever 246 and a pedal rod 248. The lower actuator 244 is configured such that the normal position is with the pedal rod 248 in the up position. To actuate the lower actuator 244 to the lowered position, the pedal rod 248 is pulled downward, which moves the lower pull rod 230 to the left and thereby causes the pivoting link 218 to pivot about the second link pivot 226 in a counter-clockwise direction. The pivoting of the pivoting link 218 causes the string puller to pivot in a clockwise direction, which lowers the tension and the pitch of the string 19. Actuating the lower actuator 244 back to the normal position, i.e. moving the pedal rod 174 upward, returns the string 19 to its open pitch.

A pair of raise pull rods 250 are arranged in parallel. A first end of each raise pull rod 250 is operatively coupled to the second end 224 of the pivoting link 218 via a sleeve 228 and a tuning fastener 234. The second end of each raise pull rod 250 is coupled to a raise actuator 254. The raise actuators 254 operate in basically the same manner, so only one actuator need be described in detail. The raise actuator 254 is configured such that the normal position is with the pedal rod 248 in the up position. To actuate the raise actuator to the raised position, the pedal rod 248 is pulled downward, which moves the raise pull rod 250 to the right. This movement of the raise pull rod 250 causes the pivoting link 218 to pivot about the first sleeve 228 disposed on the lower pull rod 230 in a counter-clockwise direction. This in turn causes the string puller 210 to pivot in a counter-clockwise direction, which raises the tension and pitch of the string 19.

Like the actuators described above with respect to the pitch adjustment device 100, the actuators 244 and 250 have adjustable stops 174 for adjusting the amount of pitch adjustment provided by each actuators. The actuators may also have pedal stops 172, similar to those described above.

The tuning and operation of the pitch adjustment device 200 will now be described. To open tune the string 19, the lower actuator 244 and the raise actuators 254 are set to their normal position, such that the stop sleeve 240 is firmly against the lower stop 242, and the second end 224 of the pivoting link 218 bears against the second link pivot 226. Then, the string 19 is tuned to its open pitch using the using the tuning key 16. For lowered tuning, the lower actuator 244 is actuated to its lowered position to the limit of the stop 174. Any other actuators are left in their normal position. The tuning fastener 234 on the lower pull rod 230 is then adjusted to tune the string 19 to the desired lowered pitch. For raised tuning, the raise actuator 254 is actuated to its raised position to the limit of the stop 174. Any other actuators left in their normal position. The tuning fastener 234 is then adjusted to tune the string 19 to the desired raised pitch.

As shown in FIGS. 2-5, and described above, each string has a first pitch adjusting mechanism 100 at its head end and a second pitch adjusting mechanism 200 at its tail end. It is preferably to configure the first and second pitch adjusting mechanism 100 and 200, such that one of the mechanisms raises the string pitch upon actuation and the other mechanism lowers the pitch upon actuation.

It is further contemplated by the present invention that any of the lever actuators described above may be replaced with electromechanical devices such as solenoids, motors such as stepper motors, pneumatic actuators, or other suitable actuator for moving the cable 138 of the pitch adjustment device 100 or moving any of the adjustment rods of the pitch adjustment device 200. For example, the plunger of a solenoid could be coupled to the cable 138, and when energized, the solenoid will move the cable 138 as described above to operate the pitch adjustment device 100 thereby adjusting the pitch of the string 19.

While embodiments of the present invention have been shown and described, various modifications may be made without departing from the scope of the present invention. The invention, therefore, should not be limited, except to the following claims, and their equivalents.

What is claimed is:

1. A device for selectively adjusting the pitch of a string of a stringed musical instrument comprising:

a pivotable string puller which pivots about a first axis, said string puller having a string support surface upon which the string rests, wherein pivoting of the string puller about said first axis adjusts the pitch on the string;

a pulley rotatably mounted on said string puller which rotates about a second axis which is spaced apart from said first axis;

a cable wrapped around said pulley, said cable having a first side of the cable extending from a first side of said pulley and a second side of the cable extending from a second side of said pulley, wherein movement of said first side of the cable causes said pulley to move thereby causing the string puller to pivot in a first direction, and movement of said second side of the cable causes said pulley to move thereby causing the string puller to pivot in a second direction;

a first actuator operably coupled to said first side of the cable, said first actuator configured to actuate to move said first side of the cable between a first state in which the first side of the cable is in a normal position such that said string puller is in a normal position and said string is tuned to an open pitch, and a second state in which the first side of the cable is in an adjusted position such that said string puller is in an adjusted position and said string is tuned to a first adjusted pitch different from said open pitch;

a second actuator operably coupled to said second side of the cable, said second actuator configured to actuate to move said second side of the cable between a first state in which the second side of the cable is in a normal position such that said string puller is in a normal position and said string is tuned to an open pitch, and a second state in which the second side of the cable is in an adjusted position such that said string puller is in an adjusted position and said string is tuned to a second adjusted pitch different from said open pitch.

2. The device of claim 1 wherein said first actuator is a lower actuator such that said first adjusted pitch is a lowered pitch, and said second actuator is a raise actuator such that said second adjusted pitch is a raised pitch.

3. The device of claim 1 wherein said second actuator is a lower actuator such that said second adjusted pitch is a lowered pitch, and said first actuator is a raise actuator such that said first adjusted pitch is a raised pitch.

4. The device of claim 1 wherein said first actuator is a lower actuator such that said first adjusted pitch is a first lowered pitch, and said second actuator is a lowered actuator such that said second adjusted pitch is a second lowered pitch different from said first lowered pitch.

5. The device of claim 1 wherein said first actuator is a raise actuator such that said first adjusted pitch is a first raised pitch, and said second actuator is a raise actuator such that said second adjusted pitch is a second raised pitch different from said first raised pitch.

6. The device of claim 5 further comprising a second stop coupled to said first side of the cable which stops the movement of the first cable at its normal position, and a second adjustable pitch stop which stops the movement of the second cable at its adjusted position, said second adjustable pitch stop being adjustable to adjust the adjusted pitch of the string caused by the first actuator.

7. The device of claim 1 further comprising a first stop coupled to said first side of the cable which stops the movement of the first cable at its normal position, and a first adjustable pitch stop which stops the movement of the first cable at its adjusted position, said first adjustable pitch stop being adjustable to adjust the adjusted pitch of the string caused by the first actuator.

8. A stringed musical instrument comprising:

a head end and a tail end;

a plurality of strings extending from said head end to said tail end, the tail end of each string being attached to a pitch adjusting device comprising:

a pivotable string puller which pivots about a first axis, said string puller having a string support surface upon which the string rests, wherein pivoting of the string puller adjusts the pitch on the string;

a pulley rotatably mounted on said string puller which rotates about a second axis which is spaced apart from said first axis;

a cable wrapped around said pulley, said cable having a first side of the cable extending from a first side of said pulley and a second side of the cable extending from a second side of said pulley, wherein movement of said first side of the cable causes said pulley to move thereby causing the string puller to pivot in a first direction, and movement of said second side of the cable causes said pulley to move thereby causing the string puller to pivot in a second direction;

a first actuator operably coupled to said first side of the cable, said first actuator configured to actuate to move said first side of the cable between a first state in which the first side of the cable is in a normal position such that said string puller is in a normal position and said string is tuned to an open pitch, and a second state in which the first side of the cable is in an adjusted position such that said string puller is in an adjusted position and said string is tuned to a first adjusted pitch different from said open pitch;

a second actuator operably coupled to said second side of the cable, said second actuator configured to actuate to move said second side of the cable between a first state in which the second side of the cable is in a normal position such that said string puller is in a normal position and said string is tuned to an open pitch, and a second state in which the second side of the cable is in an adjusted position such that said string puller is in an adjusted position and said string is tuned to a second adjusted pitch different from said open pitch.

* * * * *